US006692195B2

(12) United States Patent
Jansson

(10) Patent No.: US 6,692,195 B2
(45) Date of Patent: Feb. 17, 2004

(54) PLANTABLE NOISE ABATEMENT WALL

(76) Inventor: Jan Erik Jansson, 814 S. Sierra Ave., Solana Beach, CA (US) 92075-2616

( * ) Notice: Subject to any disclaimer, the term of this patent is extended or adjusted under 35 U.S.C. 154(b) by 0 days.

(21) Appl. No.: 10/001,440

(22) Filed: Oct. 25, 2001

(65) Prior Publication Data

US 2003/0082013 A1 May 1, 2003

(51) Int. Cl.[7] ..... E02D 29/02
(52) U.S. Cl. ..... 405/286
(58) Field of Search ..... 405/284, 286, 405/16, 262; 52/604, 169.1, 169.2, 169.3, 169.4

(56) References Cited

U.S. PATENT DOCUMENTS 4,273,476 A * 6/1981 Kotulla et al. ..... 405/284
4,707,962 A * 11/1987 Meheen ..... 52/565
4,785,577 A * 11/1988 Lederbauer ..... 405/284
5,066,169 A * 11/1991 Gavin et al. ..... 405/284
5,564,865 A 10/1996 Jansson
5,807,030 A * 9/1998 Anderson et al. ..... 405/286
6,079,908 A * 6/2000 Anderson ..... 405/286

* cited by examiner

*Primary Examiner*—Michael Safavi
(74) *Attorney, Agent, or Firm*—Wood, Phillips, Katz, Clark & Mortimer

(57) ABSTRACT

For abating noise along a highway, along a railway, or along another noise-generating way, a wall having an anterior face and a posterior face comprises, across each face, concrete modules stacked in an upper tier, at least one intermediate tier, and a lower tier. Each module is plantable and has a batten. Across each face, the modules are spaced laterally from one another in courses, one course in each tier, so that modules of each course straddle modules of the next course above or below said course. In each of alternate ones of the tiers, a geogrid strip is deployed around the battens of the modules along the anterior face and around the battens of the modules along the posterior face, in a zig-zag pattern, so as to tie the modules along the anterior face to the modules along the posterior face. The modules across each face are embedded partially in an earthen, noise-absorbing mass, through which the geogrid strips pass and which is situated between the modules across the anterior face and the modules across the posterior face.

16 Claims, 1 Drawing Sheet

PLANTABLE NOISE ABATEMENT WALL

FIELD OF THE INVENTION

This invention pertains to an improved wall for abating noise along a highway, along a railway, or along another noise-generating way. The improved wall, which has an anterior face and a posterior face, employs concrete modules, preferably plantable modules, in plural tiers, and employs flexible ties, such as geogrid strips, which tie certain modules in a given tier, at a given face of the wall, to other modules in the same tier, at an opposite face of the wall.

BACKGROUND OF THE INVENTION

U.S. Pat. No. 5,564,865, the disclosure of which is incorporated herein by reference, explains that retaining walls are used widely to construct soil embankments, sound barriers, and highway dividers, as well as for other similar and dissimilar purposes.

U.S. Pat. No. 5,564,865, supra, discloses a concrete module, which is useful in making a retaining wall. U.S. Pat. No. 5,564,865, supra, also discloses a retaining wall comprising concrete modules stacked in multiple courses, in which the modules of each intermediate course are straddled by modules of the next course above and by modules of the next course below. Each module is disclosed as being plantable. Further, each module is disclosed as being provided with a batten, which is used to anchor a geogrid embedded within an earthen mass.

SUMMARY OF THE INVENTION

This invention provides an improved wall for abating noise along a highway, along a railway, or along another noise-generating way. The improved wall, which has an anterior face and a posterior face, comprises, across each face, concrete modules stacked in an upper tier, at least one intermediate tier, and a lower tier. Preferably, each module conforms to the module disclosed in U.S. Pat. No. 5,564,865, supra. Preferably, each module is provided with a batten, which may conform to the batten disclosed in U.S. Pat. No. 5,564,865, supra.

Across each face, the modules are spaced laterally from one another in courses, one course in each tier, so that modules of each course straddle modules of the next course above or below said course. In selected ones of the tiers, the modules along the anterior face are tied to the modules along the posterior face, via flexible ties. The flexible ties may be flexible strips, such as geogrid strips, which are preferred. Alternatively, the flexible ties may be wire cables, wire ropes, polymeric ropes, etc.

Preferably, if each module is provided with a batten, the flexible ties are arranged so that, in each of selected ones of the tiers, a flexible tie is deployed around the battens of the modules along the anterior face and around the battens of the modules along the posterior face so as to tie the modules along the anterior face to the modules along the posterior face.

In a preferred embodiment, in which each module is provided with a batten, the flexible ties are arranged so that, in each of alternate ones of the tiers, a flexible tie is deployed around the battens of the modules along the anterior face and around the battens of the modules along the posterior face, in a zig-zag pattern, so as to tie the modules along the anterior face to the modules along the posterior face.

Preferably, the modules across each face are embedded partially in a noise-absorbing mass, preferably earthen, through which the flexible ties pass and which is situated between the modules across the anterior face and the modules across the posterior face.

DETAILED DESCRIPTION OF THE ILLUSTRATED EMBODIMENT

Figure 1:
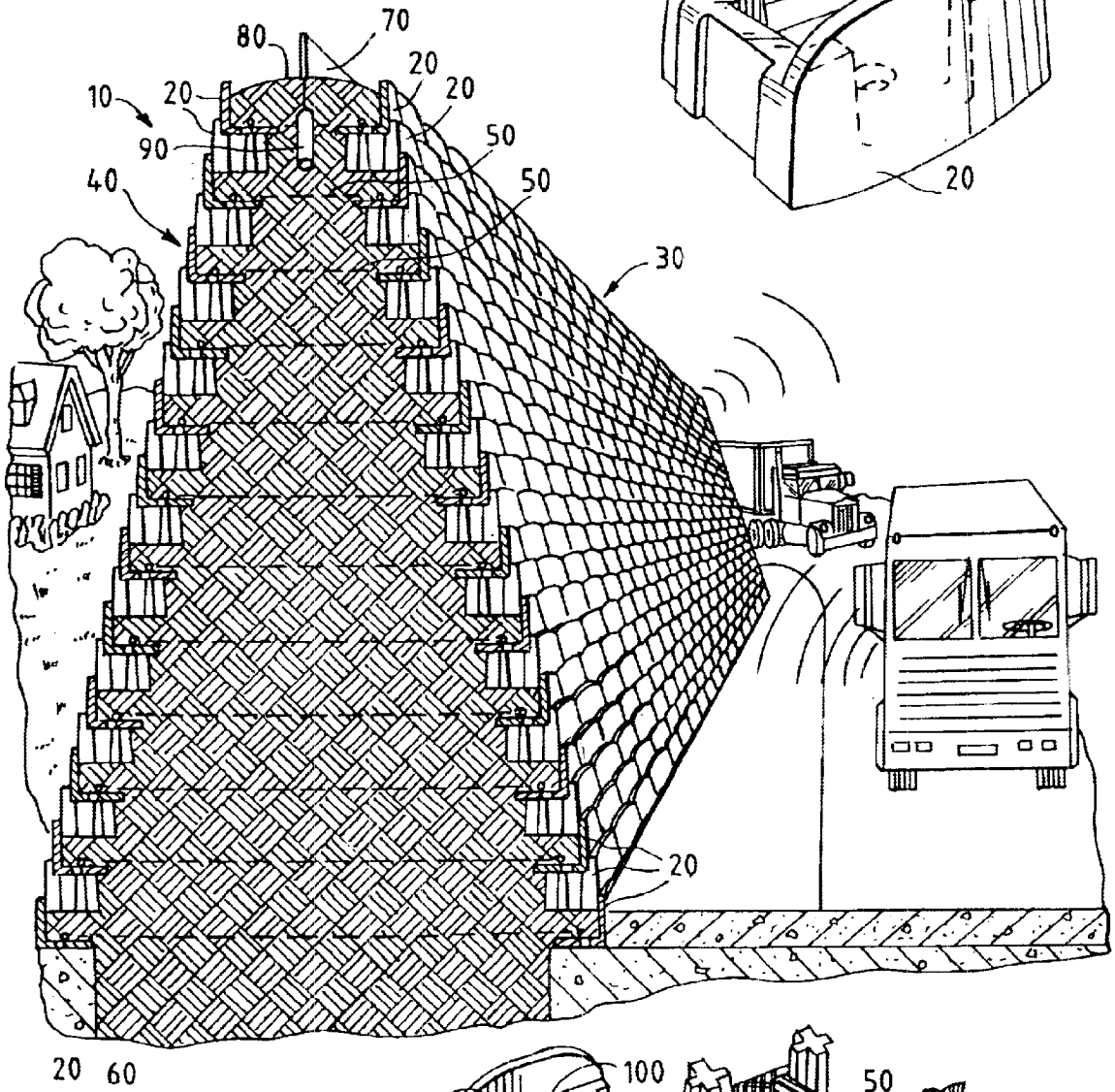
FIG. 1 is a perspective view of a cross-section taken through a noise-abating wall employing concrete modules, separating a highway from a residential area, and constituting a preferred embodiment of this invention.
Figure 2:
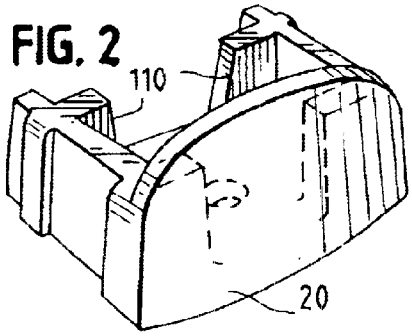
FIG. 2, on an enlarged scale, is a perspective view of a representative one of the concrete modules employed in the noise-abating wall of FIG. 1, each module conforming to the module disclosed in U.S. Pat. No. 5,564,865, supra, whereby each module is plantable and has a batten, which is not shown in FIG. 2.

As shown in FIG. 1, a noise-abating wall 10 employing concrete modules 20 and separating a highway from a residential area constitutes a preferred embodiment of this invention. The noise-abating wall 10 has an anterior face 30 facing the highway and a posterior face 40 facing the residential area. Across each of the faces 30, 40, the modules 20 are spaced laterally from one another in courses, one course in each tier, so that modules 20 of each course straddle modules 20 of the next course above or below said course. Optionally, the modules 20 across each of the faces 30, 40, may be post-tensioned, in a manner disclosed in U.S. Pat. No. 5,564,865, supra.

In alternate ones of the tiers, the modules 20 along the anterior face 30 are tied to the modules 20 along the posterior face 40, via geogrid strips 50, which are employed as flexible ties. Preferably, each geogrid strip 50 is made from a woven, polymeric fabric of a type available commercially from Mirafi Company of Charlotte, N.C.

The modules 20 across the anterior face 30 and the modules 20 across the posterior face 40 are embedded partially in a noise-absorbing mass 60, preferably an earthen mass, through which the geogrid strips 50 pass and which is situated between the modules 20 across the anterior face 30 and the modules 20 across the posterior face 40. As shown, the noise-abating wall 10 may have a fence 70 extending along its crest 80 and anchored in concrete posts 90 (one shown) embedded in the noise-absorbing mass 60.

Alternatively, the noise-absorbing mass 60 may have a core of timbers, tire carcasses, broken concrete, broken asphalt, or other similar or dissimilar materials, along with an earthen layer covering the core across the anterior face 30 and along with an earthen layer covering the core across the posterior face 40.

Figure 3:
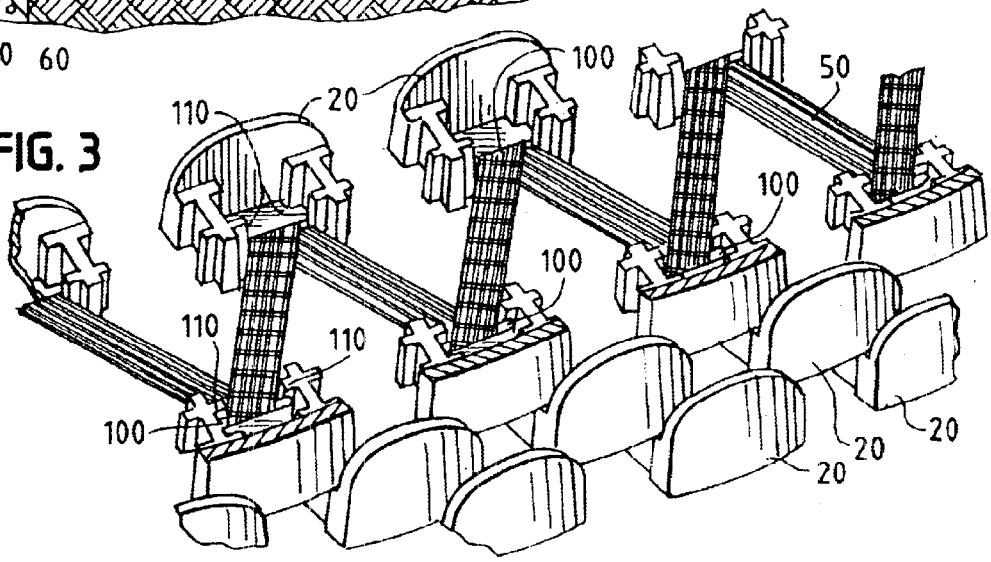
FIG. 3, on an intermediate scale, is a schematic, fragmentary, perspective view showing a flexible tie deployed around the battens of the modules along the anterior face and around the battens of the modules along the posterior face, in a zig-zag pattern, so as to tie the modules along the anterior face to the modules along the posterior face.

Each module 20 conforms to the module disclosed in U.S. Pat. No. 5,564,865, supra, whereby each module 20 is plantable and whereby each module 10 is provided with a batten 100 (see FIG. 3) which may be may be a rigid, tubular piece of polyvinyl chloride pipe and which is retained within said module 20 by back ribs 110 of said module 20, in a manner disclosed in U.S. Pat. No. 5,564,865, supra.

In each of alternate ones of the tiers, a geogrid strip 50 is deployed around the battens 110 of the modules 20 along the anterior face 30 and around the battens 110 of the modules 20 along the posterior face 40, in a zig-zag pattern wherein the geogrid strip 50 passes through the noise-absorbing mass 60, so as to tie the modules 20 along the anterior face 30 to the modules 20 along the posterior face 40. At each of its ends, the geogrid strip 50 is tied to one of the battens or is embedded in the noise-absorbing mass 60.

Because the modules 20 are plantable, vegetation can be planted in each module 20 across each face 30, 40, so as to cause the noise-abating wall 10 to have a pleasing appearance whether viewed from the highway or from the residential area.

What is claimed is:

1. A wall for abating noise along a highway, along a railway, or along another noise-generating way, the noise-abating wall having an anterior face and a posterior face and comprising, across each face, concrete modules stacked in an upper tier, at least one intermediate tier, and a lower tier, each module being plantable, wherein, across each face, said modules are spaced laterally from one another in courses, one course in each tier, so that modules of each course straddle modules of the next course above or below said course, and wherein, in selected ones of the tiers, a plurality of modules in each of said selected ones of the tiers along the anterior face are tied to a plurality of modules along the posterior face by a single continuous flexible tie.

2. The wall of claim 1 wherein the flexible tie in each of said selected ones of the tiers is a flexible strip.

3. The wall of claim 2 wherein the flexible tie in each of said selected ones of the tiers is a geogrid strip.

4. A wall for abating noise along a highway, along a railway, or along another noise-generating way, the noise-abating wall having an anterior face and a posterior face and comprising, across each face, concrete modules stacked in an upper tier, at least one intermediate tier, and a lower tier, each module being plantable and having a batten, wherein, across each face, said modules are spaced laterally from one another in courses, one course in each tier, so that modules of each course straddle modules of the next course above or below said course, and wherein, in each of selected ones of the tiers, a continuous flexible tie is deployed back and forth around the battens of a plurality of the modules along the anterior face and around the battens of a plurality of the modules along the posterior face so as to tie the modules along the anterior face to the modules along the posterior face.

5. The wall of claim 4 wherein each flexible tie is a flexible strip.

6. The wall of claim 5 wherein each flexible tie is a geogrid strip.

7. A wall for abating noise along a highway, along a railway, or along another noise-generating way, the noise-abating wall having an anterior face and a posterior face and comprising, across each face, concrete modules stacked in an upper tier, at least one intermediate tier, and a lower tier, each module being plantable and having a batten, wherein, across each face, said modules are spaced laterally from one another in courses, one course in each tier, so that modules of each course straddle modules of the next course above or below said course, and wherein, in each of selected ones of the tiers, a continuous flexible tie is deployed back and forth around the battens of a plurality of the modules along the anterior face and around the battens of a plurality of the modules along the posterior face, in a zig-zag pattern, so as to tie the modules along the anterior face to the modules along the posterior face.

8. The wall of claim 7 wherein each flexible tie is a flexible strip.

9. The wall of claim 8 wherein each flexible tie is a geogrid strip.

10. A wall for abating noise along a highway, along a railway, or along another noise-generating way, the noise-abating wall having an anterior face and a posterior face and comprising, across each face, concrete modules stacked in an upper tier, at least one intermediate tier, and a lower tier, each module being plantable and having a batten, wherein, across each face, said modules are spaced laterally from one another in courses, one course in each tier, so that modules of each course straddle modules of the next course above or below said course, and wherein, in each of alternate ones of the tiers, a continuous flexible tie is deployed back and forth around the battens of a plurality of the modules along the anterior face and around the battens of a plurality of the modules along the posterior face, in a zig-zag pattern, so as to tie the modules along the anterior face to the modules along the posterior face.

11. The wall of claim 10 wherein the flexible ties are flexible strips.

12. The wall of claim 11 wherein the flexible ties are geogrid strips.

13. The wall of any one of claims 1 through 12 wherein the modules across each face are embedded partially in a noise-absorbing mass, through which the flexible ties pass and which is situated between the modules across the anterior face and the modules across the posterior face.

14. The wall of claim 13 wherein the noise-absorbing mass is earthen.

15. The wall of any one of claims 1, 4, 7 or 10, wherein the modules of said lower tier and said at least one intermediate tier include portions spaced beyond the modules of the next higher tier to present an uncovered, upwardly open plantable interior in the lateral spacing between modules in the next higher tier.

16. The wall of claim 15, wherein said modules include side walls and a bottom defining said plantable interior.

* * * * *